United States Patent [19]

Fischer

[11] Patent Number: 5,033,400

[45] Date of Patent: Jul. 23, 1991

[54] THREAD TENSIONING DEVICE FOR A SEWING MACHINE

[75] Inventor: Jochen Fischer, Detmold, Fed. Rep. of Germany

[73] Assignee: Kochs Adler Aktiengesellschaft, Fed. Rep. of Germany

[21] Appl. No.: 456,347

[22] Filed: Dec. 26, 1989

[30] Foreign Application Priority Data

Dec. 23, 1988 [DE] Fed. Rep. of Germany ..... 3843373

[51] Int. Cl.[5] ..... D05B 47/04

[52] U.S. Cl. ..... 112/254; 112/278

[58] Field of Search ..... 112/254, 255, 278, 59, 112/229, 233

[56] References Cited

U.S. PATENT DOCUMENTS 4,793,273 12/1988 Hara et al. ..... 112/254

4,873,931 10/1989 Takagi et al. ..... 112/255 X

FOREIGN PATENT DOCUMENTS 1273861 7/1968 Fed. Rep. of Germany .

2606035 8/1977 Fed. Rep. of Germany .

*Primary Examiner*—Peter Nerbun

*Attorney, Agent, or Firm*—Ostrolenk, Faber, Gerb & Soffen

[57] ABSTRACT

A device on a sewing machine for controlling the tensile stress (F) applied to a thread as it is being fed in the sewing process, including a device for producing a frictional force acting on the thread, a setting member, a force-measuring device, and a control unit for controlling the tensile stress (F) in the thread. The setting member functions commonly as the force measurement sensor and the force-applying device.

17 Claims, 5 Drawing Sheets

THREAD TENSIONING DEVICE FOR A SEWING MACHINE

BACKGROUND OF THE INVENTION

1. Field of the Invention

The present invention relates to a device on a sewing machine for applying a tensile stress to a material to be used in the sewing process as it is being fed, such as a thread or a ribbon. It relates more particularly to a sewing machine having guides for the material, means for generating a controlled frictional force acting on the material, a forcemeasuring device, and a control unit connected to the force-measuring device and the force generating means.

2. Background Art

One such device is disclosed in Federal Republic of Germany Patent 28 09 848 (corresponding to U.S. Pat. No. 4 289 087) in which a thread-tensioning device has a setting drive for applying a force to pressure disks, a pressure sensor for detecting the force exerted by the setting drive, and a control responsive to the pressure sensor for regulating the tensile force applied to the thread. One problem arises from the fact that the tensile force equals the product of the force times the coefficient of friction. Since the control's function is exclusively to maintain the force constant, this device has the disadvantage that the coefficient of friction remains unconsidered, so that while the thickness of the thread to be tensioned is considered by the control, its sliding frictional properties are not. In addition, in the known device, variations due to varying speeds of passage are not taken into account. This leads to the necessity of readjusting the device when the sewing machine is loaded with a thread having different sliding frictional properties. Furthermore, because of these drawbacks, this device is only conditionally suitable for use in a programmable sewing system in which the tension of the thread is intended to be varied, as one of the operating parameters in a sewing program.

Federal Republic of Germany Patent 26 06 35 discloses a device for measuring thread tension in a sewing operation in which a thread tension feeler is arranged in the region between a thread tensioner and the stitch-forming area of the sewing machine. The known device serves to detect tension irregularities when stitches are being formed and is used to generate a stitch-error signal which is provided to a corresponding indicating device. That patent does not disclose any means for controlling the tensile stress to be applied to a thread in order to control the thread tension.

An arrangement for measuring thread, ribbon or wire tension is disclosed in Federal Republic of Germany Patent AS 12 73 861, in which a piezoelectric crystal is used for the measurement process. This patent generally suggests using the disclosed arrangement as a measurement-value transmitter as part of a control system which includes a brake which acts on the thread.

According to another document, U.S. Pat. No. 2,810,532, it is also possible to apply a tensile force to a material to be sewn by using a so-called drum-type tensioning device.

The disclosures of the prior art materials mentioned herein are expressly incorporated by reference.

SUMMARY OF THE INVENTION

In view of the foregoing drawbacks and shortcomings of the prior art, the main object of the present invention is to provide a controllable threadtensioning device which operates reliably, regardless of the nature of the material to be tensioned and which, at the same time, is of simple construction and can be manufactured economically.

This object may be achieved by a thread tensioning device on a sewing machine for applying, measuring and controlling a tensile stress on a sewing material, such as a thread or ribbon, as it is being fed to a sewing point on said sewing machine, said sewing machine having guide means for guiding the material to and from the thread tensioning device, said thread tensioning device comprising a setting device arranged on said sewing machine and associated with said guide means, force applying means on said setting device for engaging and applying a tensile force to said material; indicating means on said setting device for producing an indication of an actual tensile force on said material; and control means connected to said force applying means and said indicating means for inputting a desired tensile force; receiving said indication of said actual tensile force; and controlling said force applying means for applying said desired tensile force to said material.

The tensioning members which guide the material in known sewing machines are replaced by a device in which the force-measuring device and the force-applying device are combined. Thus, it is possible to control the tensile force on the thread without requiring any additional deflection points or obstructions to the passage of the material.

The setting device is mounted on the sewing machine to move in response to the actual tensile force on the material. Thus, the setting device changes position as a result of the tensile force applied to the material, this change in position being used for the measurements which are to be carried out.

The setting device may include a lever mounted pivotally on the sewing machine. The movement of the lever may be resisted by a spring element, and the indication of the actual tensile force may be produced in response to such movement. These features of the invention permit a structurally simple development.

The indicating means may be an optical measurement-value detector, advantageously involving a light beam reflected from the movable lever, which can easily be adapted to specific application requirements, still maintaining precision of measurement.

On the other hand, the indicating means may include an inductive path transmitter on the sewing machine associated with a metallic part of the lever. This permits an economical construction in which a minimum number of structural parts is used.

The lever may include a flexible arm or cantilever arm which bends in response to the actual tensile force, in which case the indicating means preferably includes a strain gauge which detects the bending. A construction which is low in undesirable play of the various elements is obtained by these inventive features.

The force-applying means may be actuated by an electromagnetic actuator. The actuator may be mounted fixed on the sewing machine while being linked to the force-applying means which is mounted on the lever and movable therewith. With these features, the measurement system is not affected by the weight of the actuator.

According to a further advantageous feature, the actuator applies its actuating force substantially along the pivot axis of the lever. This permits the thread tension force to be applied to the measurement system without subjecting the system to any forces of reaction.

A display device may also be provided which displays the desired tensile force. This permits simple control of the tensile force to be applied to the material.

Other objects, features and advantages of the present invention will be understood from the following detailed description of embodiments thereof, with reference to the drawings.

DETAILED DESCRIPTION

EMBODIMENT 1

Figure 1:
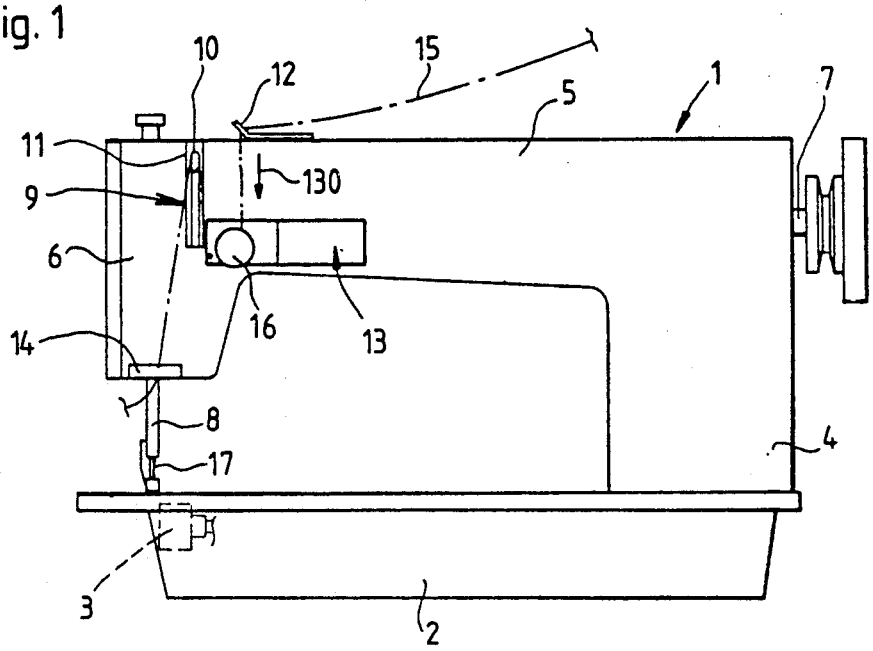
FIG. 1 is a front view of a sewing machine having a thread-tensioning device ("Embodiment 1") in accordance with a first embodiment of the invention.

A sewing machine 1 has a base plate 2 with a looper 3 turnably mounted on one end. An arm stand 4 is mounted on its other end, by screws or the like (not shown). The stand 4 is integrally formed with an arm 5 which extends parallel to the base plate 2 and terminates in a head 6. Within the arm 5, an arm shaft 7 which extends parallel to the base plate 2 is rotatably mounted. The arm shaft 7 is provided at one end with a hand wheel and at its other end drives a crank mechanism which is connected to a needle bar 8 and a thread lever drive.

The thread lever drive comprises a thread lever 9 with an end 10 which extends out of an opening 11 in the head 6. Also arranged on the arm 5 is an upper thread guide plate 12, a thread-tensioning device 13 and a lower thread guide plate 14.

In accordance with FIG. 1, a thread 15 is fed from a thread supply (not shown) through the thread guide plate 12, through a thread deflector 16 of the thread-tensioning device 13, through the end 10 of the thread lever 9, and finally through the thread guide plate 14, to a needle 17 arranged at the end of the needle bar 8 nearest the base plate 2. The needle 17 cooperates with the looper 3 at a stitch hole (not shown) in the base plate 2, defining a stitch-forming region.

As can be noted from FIGS. 2–5, the thread tensioning device 13 has a plate 18 with a bearing 19 (FIG. 3) in which one end 20 of a shaft 21 is turnably received. The free end of the shaft 21 is turnably received in a free arm 22 of an angular bearing member 23. A mounting arm 24 of the bearing member 23 is provided with a continuous bore hole 25 and is firmly attached to the plate 18. The central part of the shaft 21 has a semi-circular attachment 26 provided with a light-reflecting surface 27.

Figure 3:
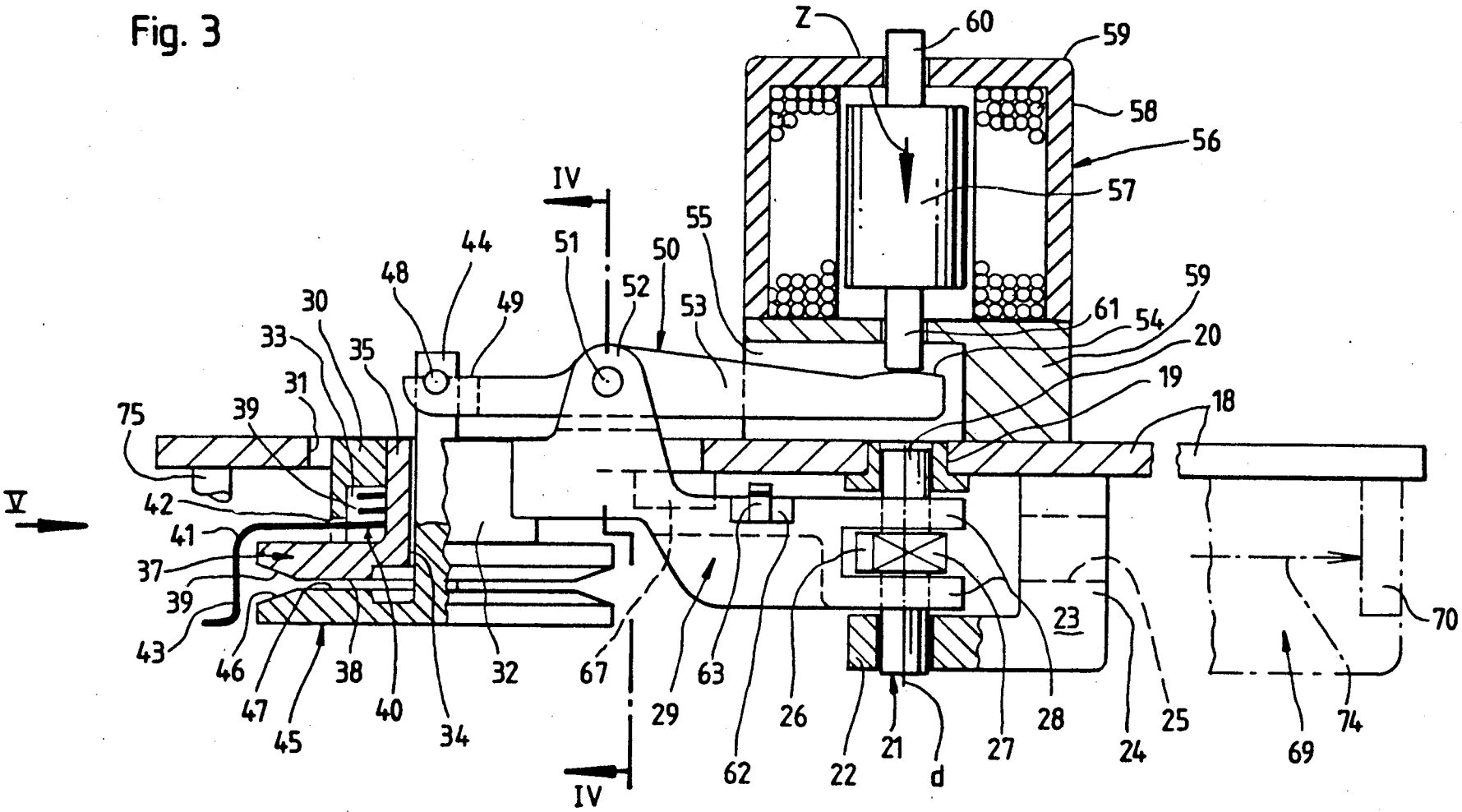
FIG. 3 is a view, partly in section, on a larger scale, taken in the direction of arrow III in FIG. 2.
Figure 5:
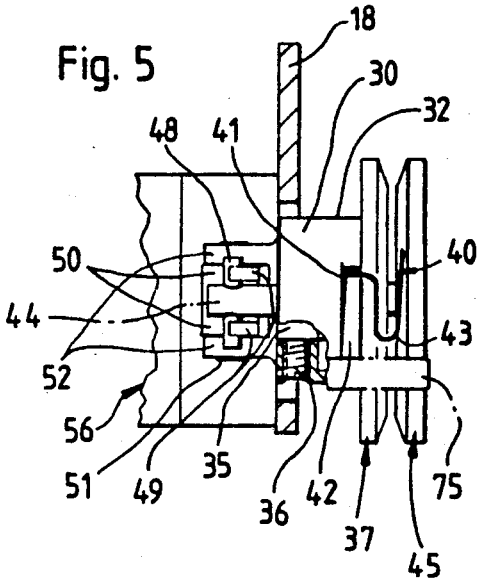
FIG. 5 is a side view of the device, as seen in the direction of arrow V in FIG. 3.

On both sides of the attachment 26, the shaft 21 is surrounded, fixed against rotation, by a forked end 28 of a lever 29. The offset, free end 30 of the lever 29 extends into a recess 31 in the plate 18 (FIG. 5). The free end 30 of the lever 29 is formed with a cylindrical part 32 which has a continuous bore (not designated in detail) and a counterbore 33 (FIG. 3). In the continuous bore (not designated in detail) a correspondingly dimensioned, closely fitting tubular extension 35 is rotatably received, and can be locked fast by means of a set screw 36 arranged in the end 30 of the lever 29. The tubular extension 35 is part of a circular disk 37 which has a clamping surface 38 and a bevel 39. The extension 35 is provided with an internal bore 34.

Figure 2:
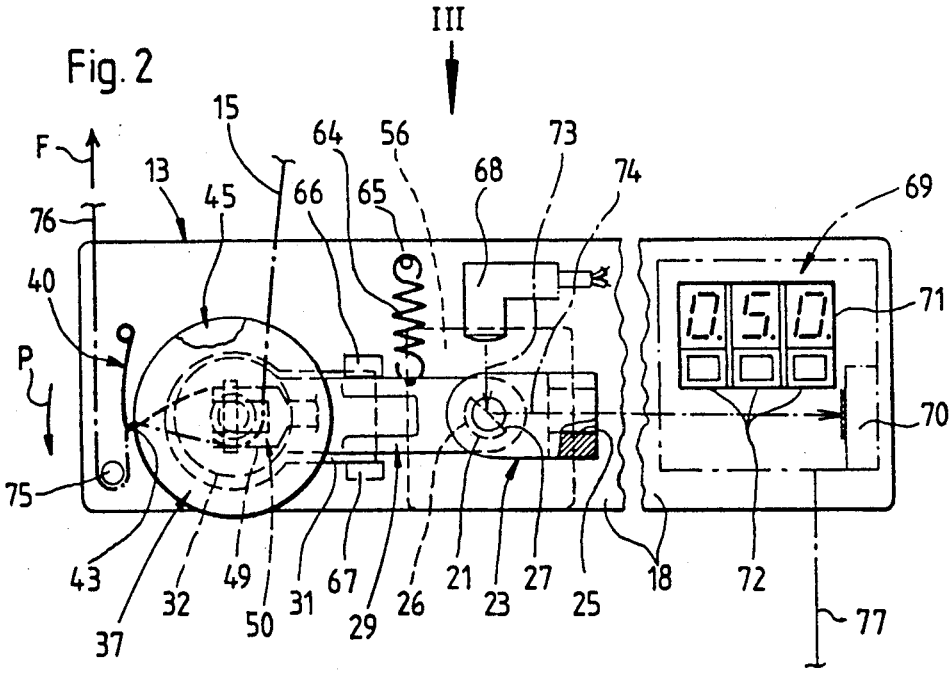
FIG. 2 shows the thread-tensioning device of FIG. 1 on a larger scale.

Within the annular hollow space **39*a* which is defined outside the tubular extension 35 of the disk 37, and within the counterbore 33 of the cylindrical part 32 there is provided a torsion spring 40, one end of which (not shown) is held fixed against rotation in a groove (also not shown) provided in the tubular extension 35. The free end 41 of the torsion spring 40 extends through an opening 42 provided in the cylindrical part 32 and is provided at its bent end with a semi-circular thread guide 43. The torsion spring 40 is pre-stressed and urges the thread guide 43 in the direction opposite the arrow P (FIG. 2**).

Furthermore, in accordance with FIG. 2, a pin 75 is fastened to the plate 18 below the thread guide 43.

As can be noted from FIG. 3, an axially displaceable bolt 44 passes through the inner bore 34 of the tubular extension 35. The bolt 44 is integral with a disk 45. The latter is shaped in a manner similar to the disk 37 and accordingly is provided with a bevel 46 and clamping surface 47. The disks 37 and 45 also have undercuts (not designated in detail) which limit their clamping surfaces 38 and 47 on the inside.

Figure 4:
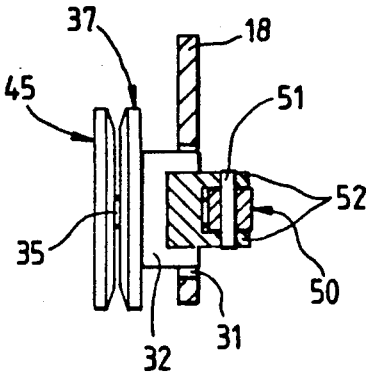
FIG. 4 is a sectional view taken along section line IV—IV in FIG. 3.

A portion of the bolt 44 between the disks 37, 45 is shown at **35*a* in FIG. 4**.

The free end of the bolt 44 extends out of the tubular extension 35 and is provided in this region with a pin 48 which passes transversely through the bolt 44 and engages a fork-shaped end 49 of a lever 50. The lever 50 is pivotally supported at its central region not designated in detail) on a bolt 51 which is borne by a fork-shaped bearing 52. The fork-shaped bearing 52 is part of the previously described lever 29.

The free end 53 of the lever 50 extends into the vicinity of the end 20 of the shaft 21 and is provided with a pressing surface 54. The end 53 of the lever 50 extends in this connection into an open space 55 within a setting device which in this embodiment comprises an electromagnet 56. The electromagnet 56 has an axially displaceable core 57 and a wire winding 58 surrounding the latter. The core 57 has two pins 60 and 61 which are displaceably mounted in the housing 59 of the electromagnet 56. The pin 61 can come into pressing contact with the pressing surface 54 of the lever 50. The construction described above provides a force Z produced by the electromagnet 56 in the direction of an axis of rotation d of the shaft 21.

The lever 29 also has a recess 62 and a pin 63 extending into it. A tension spring 64 is attached to the pin 63. The tension spring 64 is attached at its other end to a pin 65 which is provided on the plate 18. Also on the plate 18 are an upper stop 66 which the lever 29 normally rests against, and a lower stop 67 which is so arranged that the lever 29 is displaceable in the direction of the arrow P (FIG. 2) against the force of the tension spring 64. When the lever 29 moves in this fashion, the disks 37 and 45 advantageously can be moved up to about 3 mm.

On the plate 18 is provided a light source 68 (FIG. 2) which is equipped with an incandescent bulb and a lens (neither of which is shown in detail). A control unit 69 is also provided on the plate 18. In accordance with Embodiment 1, the control unit 69 has a photo-sensitive sensor 70 and a 3-place digital display 71 including an input device 72 provided with push buttons. As shown in FIG. 2, the arrangement of the light source 68, the light-reflecting surface 27 and the sensor 70 is such that a beam of light sent out by the light source 68 strikes the sensor 70 in accordance with the ray paths 73 and 74. The sensor 70 is located a substantial distance from the surface 27, which distance is selected to provide measurement sensitivity.

Referring again to FIG. 1, the operation of Embodiment 1 will now be described.

During the operation of the sewing machine 1, thread is consumed at the stitch-forming area, which causes the thread 15 passing through the needle 17 to be subjected to a frictional force at the threadtensioning device 13. The thread passes in a direction of passage 130 through the thread-tensioning device 13. The thread 15 is guided with respect to the axial deflection direction by the disks 37, 45; and with respect to the radial deflection direction by the bolt 44, specifically by the portion 35*a* of the bolt 44 (FIG. 4). As indicated in FIG. 2, a terminating thread part 76 is finally subjected to a tensile force F as the thread 15 leaves the thread tensioning device 13.

The value of the desired tensile force F is entered via the input device 72 by the operator, based on experience, as a function of parameters such as the thickness of the material, the density of the material, the thickness of the thread and the needle, etc., and this force, for instance 50 grams, as shown in FIG. 2, is displayed on the numerical display 71. In response, the control unit 69 supplies a corresponding current value to actuate the electromagnet 56. The electromagnet 56, via its core 57, exerts the force Z, the line of action of which extends in the direction of the axis of rotation d of the shaft 21. The force Z turns the lever 50 clockwise (FIG. 3) so as to pull the disk 45 is toward the disk 37, whereby the clamping surfaces 38 and 47 come into contact with the thread 15 and act on it with a frictional force. For reasons of simplification, the thread 15 has not been shown in FIG. 3.

The force Z is applied by the electromagnet 56 via the front end of the journal pin 61, on the pressing surface 54 of the lever 50. This has almost no effect on the mobility of the lever 29.

Assuming that the thread 15 is fed without any prior tension to the thread-tensioning device 13 and that the deflection of the thread part 76 by the pin 75 takes place without loss of force, the force which acts on the lever 29 bearing the disks 37 and 45 is the force F. The lever 29 is deflected in the direction of the arrow P against the force of the spring 64 until equilibrium is established. At equilibrium, the lever 29 assumes a position at a certain distance from the stops 66 and 67 and therefore without contacting the stops 66 and 67.

As the thread 15 passes through the threadtensioning device 13, the tensile force on the thread, and thus the position of the lever 29, may change as a result of disturbing influences, resulting in a turning of the reflecting surface 27. This causes the path 74 of the beam of light coming from the light source 68 to be deflected and causes a change in status to be detected by the sensor 70. The output of the sensor 70 accordingly represents the output of a force measuring device according to the invention which serves to measure the amount of the actual tensile force F. The controller 69 continuously compares the desired and the actual tensile force F. In the event of a deviation between the desired and the actual tensile force F which exceeds predetermined tolerance, the control unit 69 automatically carries out a corresponding change in the value of the current exciting the electromagnet 56.

Depending on the particular form of the sensor 70, it can detect either upper and lower limit values or a continuous value corresponding to the position of the lever 29, or both, so that a relatively accurate control of the actual tensile force F on the thread part 76 is obtained.

EMBODIMENT 2

Figure 6:
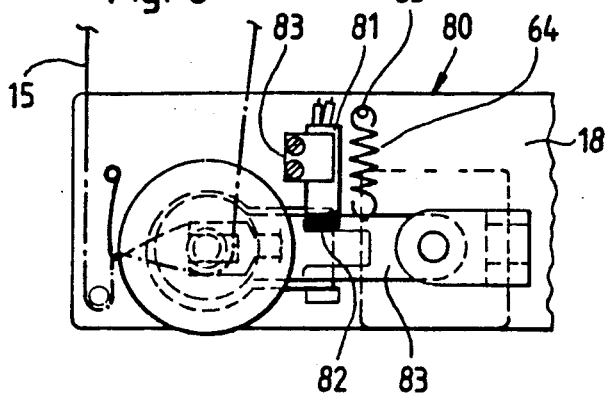
FIG. 6 is a view similar to FIG. 2, showing part of a thread-tensioning device in accordance with a second embodiment of the invention ("Embodiment 2")

FIG. 6 illustrates a thread-tensioning device 80 which, except for the parts described below, corresponds to the construction of the thread-tensioning device 13. In place of the optical measuring device of Embodiment 1, the thread-tensioning device 80 has an inductive path transmitter 81. The path transmitter 81 may be a magnetic (Hall) sensor, or a linear variable displacement transducer (differential transformer), for example. It is screwed via a clamp 83 onto the plate 18. By this structure, the path transmitter 81 simultaneously assumes the function of the aforementioned upper stop 66. The path transmitter 81 cooperates with the metallic region 82 which is firmly connected to a lever 83. The latter corresponds in its construction to the lever 29.

In contras with Embodiment 1 which has been described above, in this case the optical measurement system is replaced by an inductive measurement system. The manner of operation of the other parts generally corresponds to that of Embodiment 1.

EMBODIMENT 3

The embodiment shown in FIGS. 7–10 will now be explained. A thread tensioning device 87 is provided on the head 85 of a sewing machine 86, the tensioning device being placed between two thread-guide plates 88 and 89. In contrast with Embodiments 1 and 2 described above, in Embodiment 3 a separate thread deflection point 90 is provided which is separate from the thread-tensioning device 87. From the thread deflection point 90 a thread 91 is fed to a thread lever 92 as in Embodiments 1 and 2.

The thread tensioning device 87 has a plate 93 on which an electromagnet 94 is fastened. The latter has a rectangular tubular frame 95 on both sides of which are fastened respective bearing plates 97 which are symmetrical to an axial line 96 extending through the electromagnet 94. Furthermore, hinge strips 98 and 99 made of thin spring steel are riveted fast to the bearing plates 97, the free ends of said strips being fastened by riveting to the angularly bent parts 100 and 101 of a pressure plate 102. The hinge strips 98, 99 are each provided with a strain gauge 103, 104, which gauges are firmly attached to the hinge strips 98, 99 by adhesive.

Figure 9:
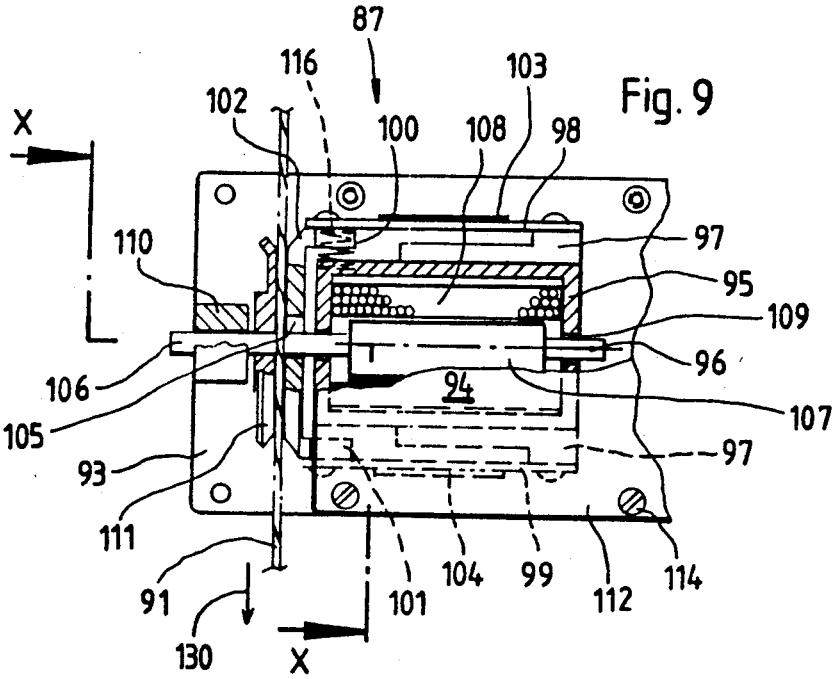
FIG. 9 is a front view on a larger scale of the thread-tensioning device shown in FIG. 7.

As can be noted from FIG. 9, the pressure plate 102 has a recess 105 which is arranged on one side of the line 96 and through which a rod 106 extends with clearance. The rod 106 is firmly attached to a cylindrical core 107 which is surrounded with clearance by a wire winding 108. The latter terminates in two electrical connections, not shown. The rod 106 is received at one end with clearance in a bore hole 109, provided in the frame 95. The other end of the rod 106 is mounted with clearance in a bearing 110, which is firmly attached to the plate 93. A pressure plate 111 is also mounted on the rod 106, preferably by pressfitting, and thus follows the movements of the rod 106.

Figure 10:
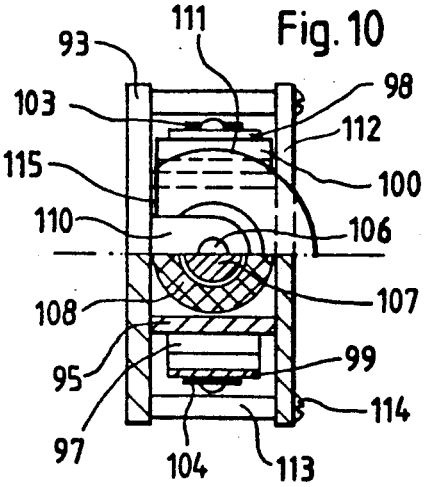
FIG. 10 is a side view of the device shown in FIG. 9, taken along the section line X-X.
Figure 7:
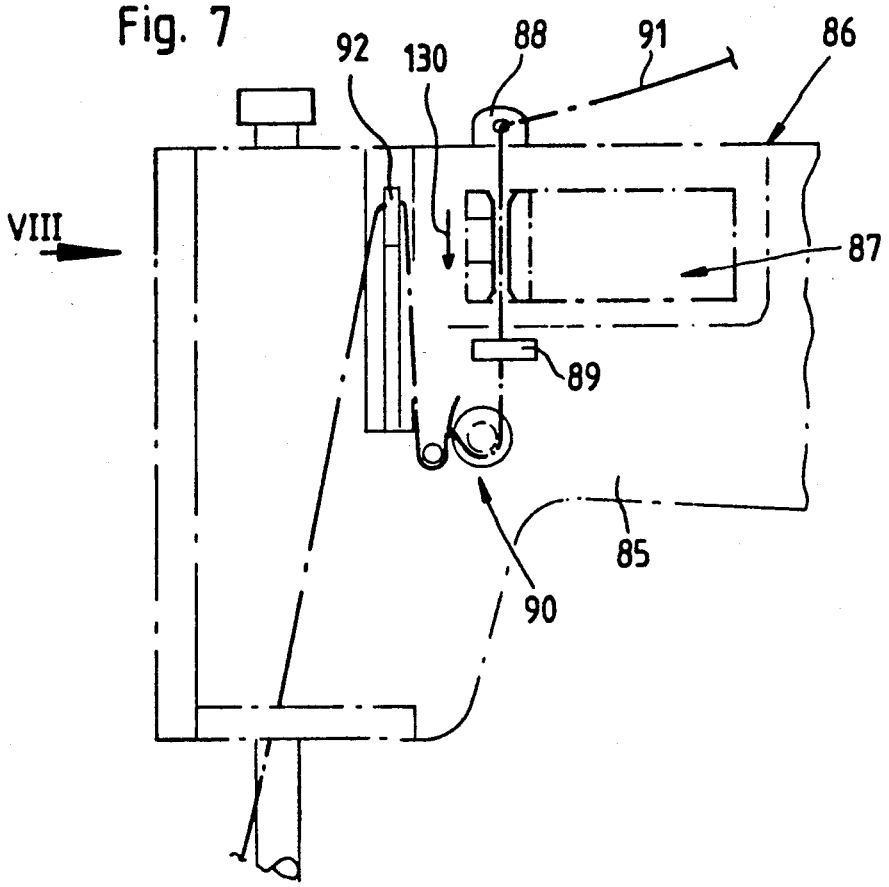
FIG. 7 is a view, corresponding to FIG. 1, of part of a sewing machine shown on a larger scale and having a thread-tensioning device according to a third embodiment of the invention ("Embodiment 3")
Figure 8:
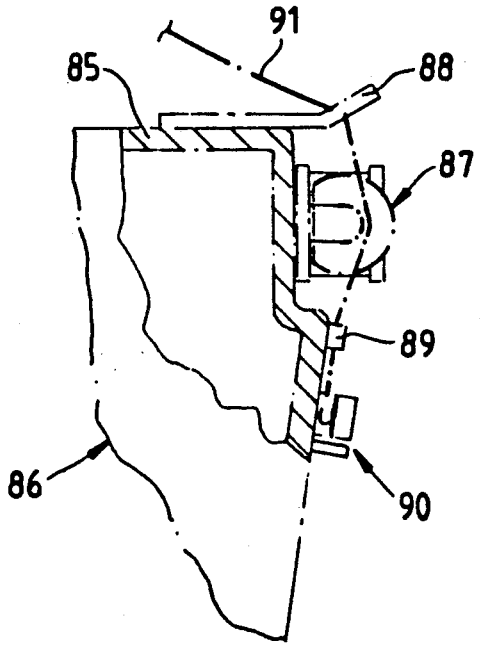
FIG. 8 :s a partial side view, shown partially in section, as seen in the direction of arrow VIII in FIG. 7.

As can be noted from FIG. 10, a plate 112 is arranged parallel to the plate 93, the two plates 93 and 112 being connected to each other via cylindrical spacers 113 by means of screws 114. As can be noted from the lower part of FIG. 9, the plate 112 extends merely far enough so that the electromagnet 94 is positioned enclosed between the two plates 93 and 112. In accordance with FIG. 10, the pressure plates 102 and 111 are circular, each of them having a guide edge 115 which prevents any twisting of the pressure plates 102 and 111. The angularly bent parts 100 and 101 formed on the pressure plate 102 are dimensioned so that the pressure plate 102 can be shifted between the two plates 93 and 112. As can be noted from FIG. 9, the angularly bent part 100 of the pressure plate 102 has a recess (not designated in detail) which encloses a compression spring 116 which rests in a recess (not shown) in the frame 95. In FIG. 9 a thread 91 is shown between the pressure plates 102 and 111, in contact with clamping surfaces (not designated in detail) of the pressure plates 102 and 111.

In Embodiment 3, the thread 91 which passes in the direction of passage 130 through the thread tension device 87 tends to carry the pressure plate 102 along in the same direction of passage 130 and against the force of the spring 116 because of the friction on the thread 91.

Such a movement is possible as a result of the fact that the pressure plate 102 is riveted to the hinge strips 98, 99, which are of the same length, forming, in combination with the pressure plate 102 and the bearing plate 92 including a part of the frame 95, a displaceable parallelogram-shaped articulation system (although no actual articulations are present).

The displacement of the pressure plate 102 leads to a change in the resistances of the strain gauges 103, 104 which are provided on the hinge strips 98 and 99 and connected in series with each other. These strips, in turn, serve as a continuous measurement-value recorder which is selectively connected to the control unit 69.

Unlike the pressure plate 102, pressure plate 111 is firmly connected to the core 107 of electromagnet 94 so that the pressure plate 111 exerts a normal force on the thread 91. During the operation of the sewing machine 86, the pressure plate 102 moves back and forth between its end positions, limited by the recess 105 and the rod 106.

In Embodiment 3, the thread 91 is guided in axial direction by the pressure plates 102, 111 and in radial direction by the rod 106.

CONTROL UNIT

Figure 11:
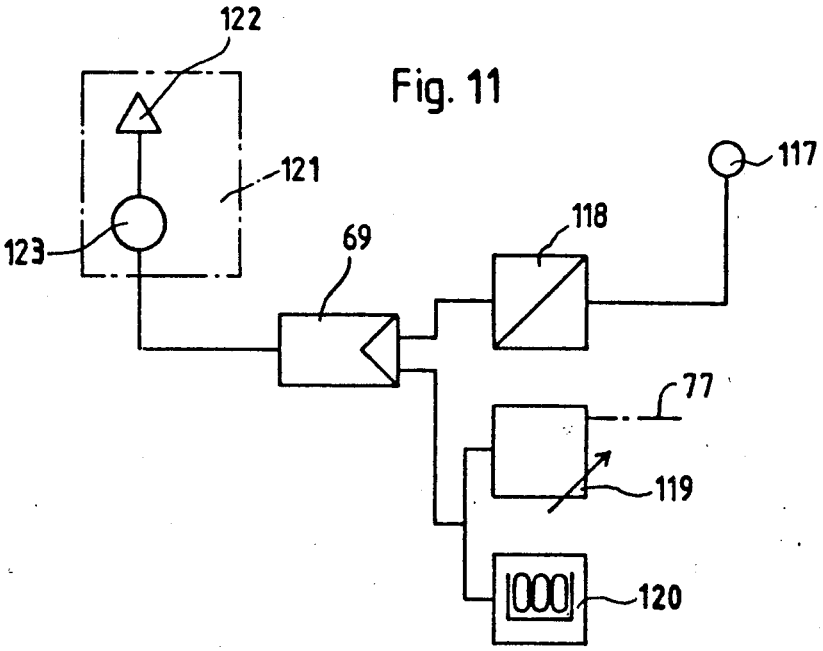
FIG. 11 is a schematic block diagram showing a control circuit which may be used with the thread-tensioning device.

Each of the devices described above in accordance with Embodiments 1, 2 and 3 is provided with the control unit 69 which is connected with the abovedesired structural parts. In accordance with the schematic block diagram in FIG. 11, a measurement-value feeler 117 (disks 37, 45 or pressure plates 102, 111) is connected with a measurement sensor 118 (sensor 70 or path transmitter 81 or strain gauges 103, 104) which, in its turn, is connected to the control unit 69. Furthermore the control unit 69 is connected to an adjuster 119 (input device 72) and to an indicator device 120 (numerical display 71). The control unit 69 is finally connected to a setting device 121 which has a setting member 122 (disks 37, 45, or pressure plates 102, 111) and a setting drive 123 (electromagnet 56 or 94).

OTHER FEATURES

Comparing Embodiments 1 and 2 with Embodiment 3 it is noted that in Embodiments 1 and 2, both of the disks 37 and 45 which rub against the thread 15 are used for measurement of the actual present tensile force F, while in Embodiment 3 only the pressure plate 102 is used for the measurement of the force.

The thread-tensioning device guided in a closed loop is common to all embodiments.

As can be noted from the description, the actual tensile force F in a material to be fed during the sewing process, such as a thread or a ribbon to be sewn, is controlled without regard to physical parameters such as, for instance, the thickness of the thread or its coefficient of friction.

The device of the invention is furthermore suitable for connection via a line 77 to a programmable control unit so that the desired tensile force can be controlled in accordance with a sewing program.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A tensioning device on a sewing machine for applying a tensile force to a material such as a thread or ribbon as it is being fed in the stitching process, said device having:

(a) applying means for applying a tensile force to said material;

(b) guide means for guiding said material, said guide means including:

(1) measuring means for measuring said tensile force on said material; and (2) an adjustment member which adjusts the tensile force applied by said applying means;

and said guide means comprises a guide member which constitutes part of both said applying means and said measuring means;

(c) adjustment means for adjusting said applied force, including an adjustment drive connected to said adjustment member; and (d) control means connected to said measuring means and said adjustment means.

2. A tensioning device on a sewing machine for applying a tensile force to a material such as a thread or ribbon as it is being fed to a stitching point, said device having:

(a) applying means for applying a tensile force to said material;

(b) guide means for guiding said material;

(c) measuring means on said guide means for measuring said tensile force on said material;

(d) an adjustment member on said guide means which adjusts the tensile force applied by said applying means;

(e) adjustment means for adjusting said applied force, including an adjustment drive connected to said adjustment member; and (f) control means connected to said measuring means and said adjustment drive;

wherein the guide means is mounted on said tensioning device to be movable in response to said actual tensile force, substantially upstream and downstream with respect to the direction of travel of the material through said guide means and toward said stitching point.

3. A device according to claim 2, further comprising spring means on said tensioning device which resists movement of said guide means in the direction of passage of the material.

4. A device according to claim 3, wherein said measuring means detects a deflection of said guide means, said deflection being induced by the tensile force in said material.

5. A device according to claim 2, wherein the guide means includes a lever mounted pivotally on said tensioning device.

6. A device according to claim 5, wherein said measuring means comprises a light source; a reflecting surface arranged on the lever which reflects light emitted by the light source; and a sensor on said tensioning device which detects said light reflected by the reflecting surface.

7. A device according to claim 5, wherein said measuring means comprises an inductive path transmitter associated with a metallic region on the lever.

8. A device according to claim 5, wherein the lever includes a flexible arm which bends in response to said actual tensile force and the measuring means includes a strain gauge which detects the bending of the flexible arm.

9. A device according to claim 5, wherein said adjustment drive includes an electromagnetic actuator which is mounted in fixed position on said tensioning device; and wherein said adjustment member is mounted on said movable lever in position for being actuated by said actuator.

10. A device according to claim 9, wherein said actuator produces a force substantially coaxially with the pivot axis of the lever.

11. A device according to claim 1, wherein said control means comprises a display device which displays the tensile force.

12. A device according to claim 11, wherein said control means has means for inputting a desired tensile force, and said display device selectively displays said desired tensile force.

13. A tensioning device on a sewing machine for applying a tensile force on a material, such as a thread or ribbon, as it is being fed along a predetermined path in the sewing process, said thread tensioning device comprising:

guide means on said sewing machine which guides said material along said predetermined path, said guide means including a guide member which engages said material;

applying means on said guide member for engaging said material and applying a tensile force to said material;

measuring means on said guide member for engaging said material and generating a measurement of an actual tensile force on said material; and control means connected to said applying means and said measuring means for receiving a desired tensile force by means of input means; receiving said measurement of said actual tensile force; and controlling said applying means in dependence upon the difference between said actual and said desired tensile force in the material, for applying said desired tensile force to said material.

14. A device according to claim 13, wherein said guide member comprises a common support lever which constitutes part of both said applying means and said measuring means.

15. A tensioning device on a sewing machine for applying a tensile force to a material, such as a thread or ribbon, as it is being fed in the stitching process, said device comprising:

applying means for applying a tensile force to said material;

adjustment means for adjusting said tensile force, including an adjustment drive;

guide means for guiding said material, said guide means comprising both an adjustment member connecting said adjustment drive to said applying means, and measuring means for measuring said tensile force on said material; and control means connected to said adjustment means and said measuring means.

16. A device according to claim 15, wherein both said adjustment member and said measuring means are on a common guide member which is disposed for engaging said material at a predetermined location.

17. A tensioning device on a sewing machine for applying a tensile force to a material such as a thread or ribbon as it is being fed along a predetermined path to a stitching point, said device comprising:

a support lever which supports and guides said material on said predetermined path;

applying means mounted on said support lever for applying said tensile force to said material;

measuring means mounted on said support lever for measuring said tensile force on said material;

an adjustment member which adjusts the tensile force applied by said applying means;

an adjustment drive connected to said adjustment member for adjusting said applied force; and control means responsive to said measuring means for controlling said adjustment drive.

* * * * *